US006093458A

United States Patent [19]

Worchester

[11] Patent Number: 6,093,458

[45] Date of Patent: Jul. 25, 2000

[54] METHOD OF MAKING IMITATION TREE AND FRAME THEREFOR

[76] Inventor: Morrill R. Worchester, Centerville Rd., Columbia Falls, Me. 04623

[21] Appl. No.: 09/132,306

[22] Filed: Aug. 11, 1998

Related U.S. Application Data

[62] Division of application No. 08/797,698, Feb. 11, 1997, Pat. No. 5,882,744.

[51] Int. Cl.[7] ..... A01N 3/00

[52] U.S. Cl. ..... 428/20; 156/61; 211/196; 428/18

[58] Field of Search ..... 428/9, 18, 19, 428/8, 17, 20, 22, 27; 211/196; 156/61

[56] References Cited

U.S. PATENT DOCUMENTS

| | | | |
|---|---|---|---|
| 2,125,907 | 8/1938 | Frei, Jr. | 428/18 X |
| 2,851,807 | 9/1958 | Taylor | 428/19 |
| 3,096,943 | 7/1963 | Forrer | 428/19 X |
| 3,210,232 | 10/1965 | Wielland | 428/19 X |
| 3,967,019 | 6/1976 | Magee | 428/18 X |
| 4,101,697 | 7/1978 | Dieffenbach et al. | 428/9 |
| 5,085,901 | 2/1992 | Johnson et al. | 428/19 |
| 5,213,407 | 5/1993 | Eisenbraum . | |
| 5,523,130 | 6/1996 | Sullivan . | |
| 5,568,966 | 10/1996 | Miller et al. . | |
| 5,677,018 | 10/1997 | Shin | 428/18 |
| 5,882,744 | 3/1999 | Worcester | 428/18 |

*Primary Examiner*—Deborah Jones
*Assistant Examiner*—Wendy Boss
*Attorney, Agent, or Firm*—Shlesinger, Arkwright & Garvey LLP

[57] ABSTRACT

An imitation tree comprising a fluid bearing support stand and a plurality of natural boughs attached to the stand, a method of making same and a support stand for attaching boughs thereto.

24 Claims, 3 Drawing Sheets

METHOD OF MAKING IMITATION TREE AND FRAME THEREFOR

This is a division of application Ser. No. 08/797,698, filed on Feb. 11, 1997 now U.S. Pat. No. 5,882,744.

FIELD OF THE INVENTION

This invention relates generally to imitation trees and more particularly to an imitation Christmas tree.

Over the years, trees have been used for indoor and outdoor decoration and enhancement. For example, during the Christmas season, millions of trees are cut down for symbolic and decorational purposes. Cutting down live trees is wasteful, cumbersome and often the natural trees are poorly shaped and sized. Accordingly, over the years, numerous artificial or imitation trees have been developed. Some examples of these artificial trees can be found in U.S. Pat. No. 4,101,697 to Dieffenbach et al.; U.S. Pat. No. 2,125,907 to Frei; U.S. Pat. No. 2,851,807 to Taylor; U.S. Pat. No. 5,085,901 to Johnson et al.; U.S. Pat. No. 3,210,232 to Wielland; and U.S. Pat. No. 3,967,019 to Magee.

These numerous attempts have still failed to provide an imitation or artificial tree that is inexpensive, environmentally friendly, but yet natural in appearance and which provides a natural tree aroma.

OBJECTS AND SUMMARY OF THE INVENTION

It is an object of the present invention to provide an artificial or imitation tree, which employs natural or artificial boughs to create a natural looking tree.

Yet another object of this invention is to provide an artificial or imitation tree, which employs real natural boughs in which the lives of the boughs can be maintained for a period of time by watering the tree.

Still a further object of this invention is to provide an artificial or imitation tree, which can be used for decoration.

Yet another object of this invention is to provide an artificial or imitation tree, which is perfectly shaped.

Still a further object of this invention is to provide an artificial or imitation tree, which can vary in size from a miniature decoration to an average Christmas tree size.

Yet another object of this invention is to provide a method of manufacturing an imitation tree, which employs natural boughs.

Still a further object of this invention is to provide a stand, which allows the simple insertion of the boughs thereto.

A further object of this invention is to provide an artificial or imitation tree, which can be purchased with ease and set up without any cumbersome effort.

Still a further object of this invention is to provide an artificial or imitation tree, which can be ordered as a gift for a third party.

Yet another object of this invention is to provide an artificial or imitation tree, which is inexpensive to manufacture, purchase and maintain.

Still a further object of this invention is to provide a natural looking imitation tree, which is environmentally friendly by utilizing only the boughs or branches of real trees.

In summary, the present invention discloses a novel configuration for an imitation tree, which includes a fluid bearing support stand and a plurality of either natural or artificial boughs attached throughout the stand forming the shape of a tree, whereby the boughs, if they are natural, absorb the fluids retained within the stand, and for a method of manufacturing such an imitation tree. Additionally, the present invention discloses a novel configuration for a support stand for attaching boughs thereto, which includes a base support, a foam pillar having a height and supported at one end by the base support and a frame substantially around the foam pillar for providing additional rigidity for the foam pillar. These and other objects of the invention will be apparent from the following:

DETAILED DESCRIPTION OF THE INVENTION

Figures 1, 10:
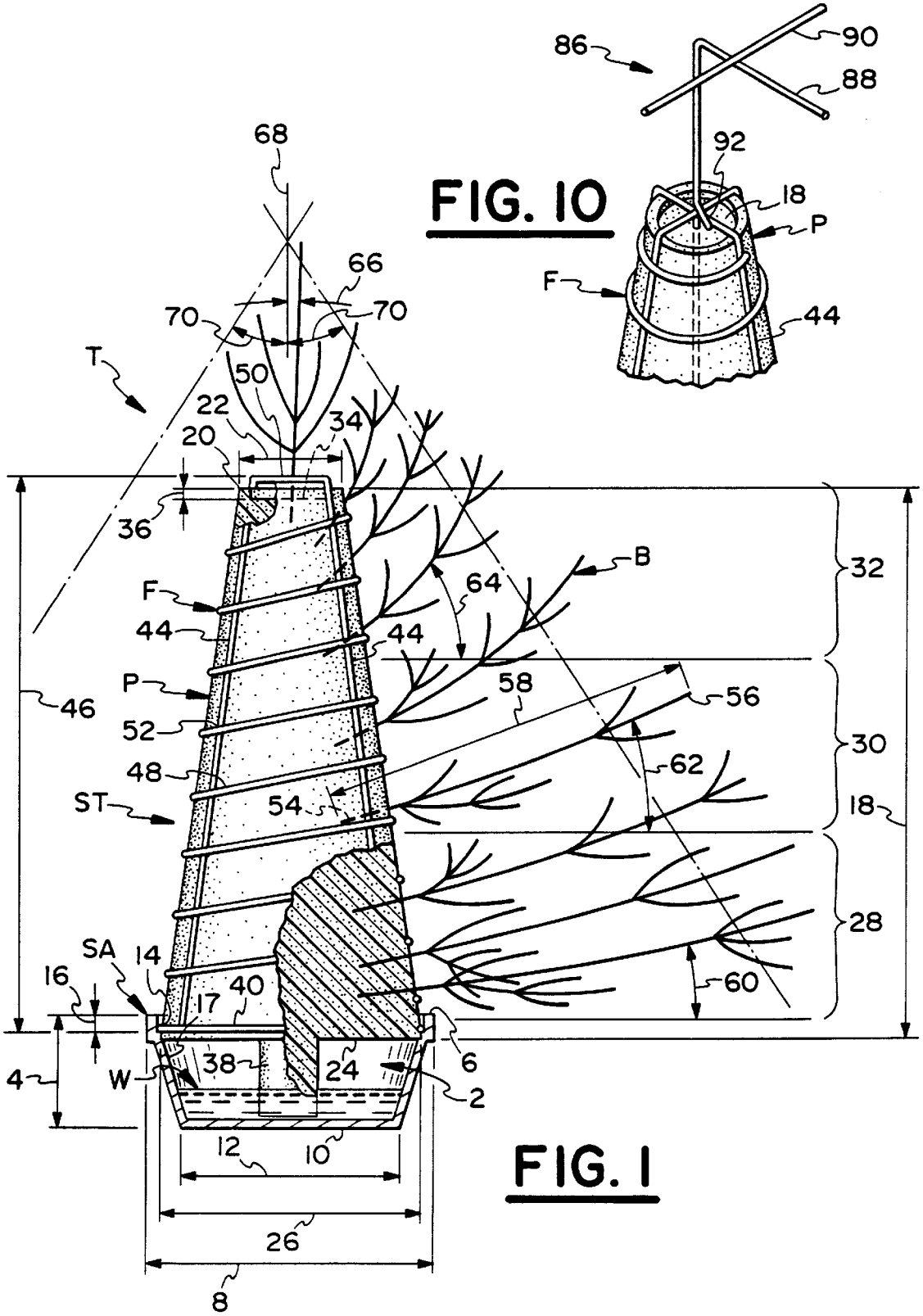
FIG. 1 is a front elevational partial cross-sectional view of this novel imitation tree.
FIG. 10 is a partial top front perspective view of the pillar and frame shown with the shipping brace.
Figure 2:
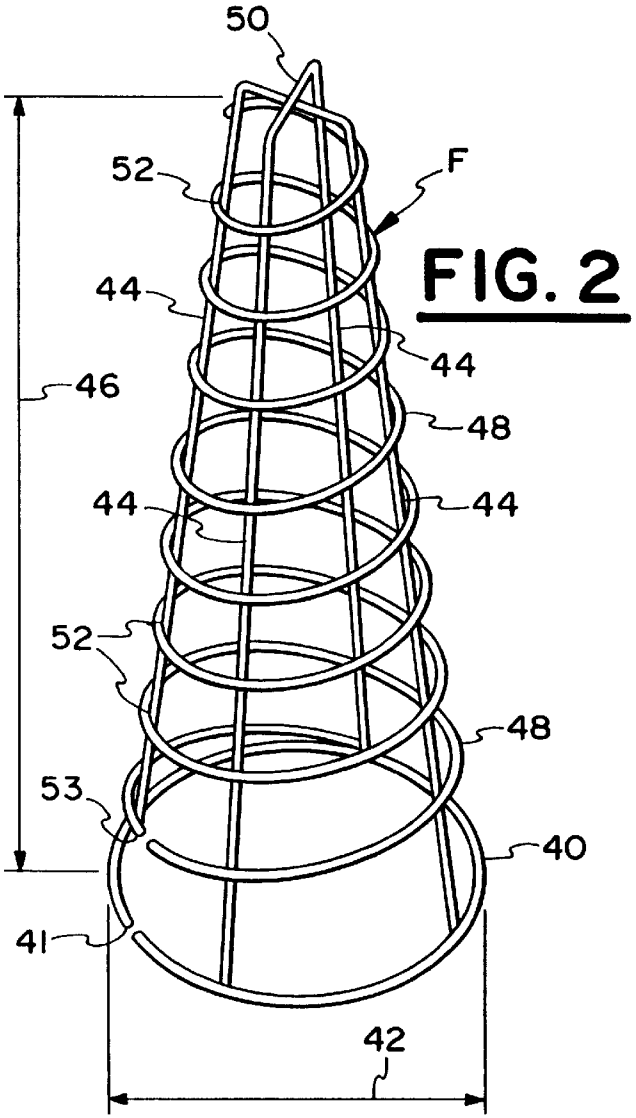
FIG. 2 is a perspective view of the frame.

FIGS. 1 and 2

Referring to FIG. 1, the imitation tree T is shown comprised of the stand ST and a plurality of boughs B.

The stand ST includes a saucer SA, a pillar P and a frame F. The saucer SA is the base support for the stand ST and it has a basin 2 for retention of excess water W that drips through the pillar P, as will be discussed further below. The saucer SA, or base support, can be of almost any shape, here it is shown in a bowl-type fashion. Tile saucer SA will have, regardless of its shape, a height 4, a top ridge 6 with a top diameter 8, as well as a bottom 10 with a bottom diameter 12. Within the saucer SA there should be a lip 14, with a lip depth 16 and an interior side wall 17. The lip 14 is the area upon which the pillar P and the frame F will rest, as will be discussed further below. For a miniature tree design, it is preferred that the top diameter 8 be about 6 inches, the bottom diameter 12 be about 4½ inches, the height 4 of the saucer SA be about 2¼ inches and the lip depth 16 be about 1½ inch.

The pillar P must be of a material that will allow the boughs B to be inserted into it and subsequently support the boughs B. It is preferred that the pillar P be of a plastic foam type of material, which is comprised of numerous cells or fibers. If the imitation tree T is to employ natural boughs B, rather than artificial boughs B, then it is further preferred that the pillar P be made of florist plastic foam. That is, a phenolic floral plastic foam that can be purchased from the manufacture, Smithers Oasis, located in Trent, Ohio. It is understood that the pillar P could be of any material so long as it retains the fluid long enough for the boughs B to absorb it, as will be discussed further below.

The pillar P can be of almost any shape, but it is preferred to be of a conical shape and even more particularly of a frustum-conical shape.

Having the frustum-conical shape, the pillar P will have a height 18, a top 20 with a top diameter 22. The pillar P will also have a base 24 with a base diameter 26. The pillar P is supported by the saucer SA because the base 24 rests on the lip 14 of the saucer SA. Accordingly, as mentioned above, in order for the pillar P to rest on the lip 14, the base diameter 26 of the pillar P must be of a lesser value than the top diameter 8 of the saucer SA. Thus, the pillar P will be supported by the lip 14. However, it is noted and shown in FIG. 1, the pillar P does not have to be supported by the lip 14. That is, the base 24 of the pillar P may extend below the lip 14 and be supported by the interior side wall 17 of the saucer SA (shown in FIG. 1).

The pillar P is divided into portions, a lower third portion 28 a middle third portion 30 and an upper third portion 32. These portions, 28, 30 and 32 are not physical divisions, but rather reference portions for the insertion of the boughs B, as will be discussed further below.

If natural boughs B are to be used, then it is preferred that the pillar P also have a well 34 extending into its body from the top 20. The well 34, having a well depth 36, is to aid in allowing water W or any other liquid food supplement to be poured into the pillar P, as will be discussed further below. As an alternative embodiment, if natural boughs B are to be used, then a wick 38 can be attached to the pillar P at its base 24 and extend into the saucer SA, as shown in FIG. 1. The wick 38 is for absorbing an excess water W or any other liquid food supplement residing in the basin 2 of the saucer SA. The wick 38 is optional. For a miniature imitation tree T, it is preferred that the height 18 of the pillar P be about 11½ inches, the top diameter 22 be about 2 inches, the base diameter 26 be about 5½ inches, and the well depth 36 be about 1¼ inch.

Referring to FIGS. 1 and 2, the frame F is a structure that is placed over the pillar P to provide stability or support for the pillar P in the lateral direction. Without the frame F, the pillar P, which is made of a foam material, will tend to fall over. The frame F is supported by the saucer SA. In other words, the base ring 40 of the frame F rests on the lip 14 of the saucer SA. Once the base ring 40 is in place, it is glued (not shown) to saucer SA in a plurality of locations. As an alternative, the base ring 40 could be similar to that of a snap ring, shown in FIG. 2. In other words, the base ring 40 could be discontinuous at one place 41. That is, the discontinuous base ring 40 would have a first and second end. As such, the base ring 40 would have to have a base ring diameter 42 slightly larger than the top diameter 8 of the saucer SA. With the base ring 40 being discontinuous at one place 41, the base ring 40 can be squeezed or compressed to fit within the top diameter 8, of the saucer SA. Once in place, the base ring 40 can be released so that it snaps or expands to the size of the top diameter 8. As such, the pressure that the base ring 40 will be exerting outwardly, will hold the frame F to the saucer SA.

The frame is also made up of support members 44 which extend the height 46 of the frame F and connect to the base ring 40. The frame F is preferred to also include a frustum-conical spiral 48 which extends from the base ring 40 to the top 50 of the frame F. The spiral 48 has a height, a base end adjacent to the base ring 40 and a top end. Wherever the spiral 48 interconnects with the support members 44, they are joined together, forming joints 52.

The top 50 of the frame F is made by the support members 44 intersecting and crossing each other. It is preferred and shown in FIG. 2, that there only be two support members 44. That is, each support member 44 is to attach to the base ring 40, extend the height 46 of the frame F and then crossover to form the top 50 of the frame F and then to extend back down the other side of the frame F and to reattach to the base ring 40. With both of the support members 44 being formed in this fashion, the support members 44 will intersect at the top 50 and at that intersection they should be joined. It is noted that more than two support members 44 could be employed.

In order to provide rigidity, the frame F is preferred to be made of wire. However, it is understood that there are numerous other materials that could be used to provide such rigidity, such as plastic. It is further preferred that the shape of the frame F be of a similar shape to that of the pillar P, in order for the frame F to fit smoothly over the pillar P. Shown in FIGS. 1 and 2, the frame F is of a frustum-conical shape.

It is further understood that the frame F need not entirely surround the pillar P. In other words, the frame F could partially or substantially surround the pillar P, so long as it provides support for the pillar P.

Additionally, if the base ring 40 is to be like a snap ring, then the frustum-conical spiral 48 could also be cut 53, or be discontinuous in its lower portion, to aid in the insertion of the frame into the saucer SA, as shown in FIG. 2.

For the miniature tree T design, it is preferred that the base ring diameter 42 be about 5½ inches, the frame height 46 be about 12 inches and that the spiral 48 be welded to the support members 44 at all of the joints 52.

Referring again to FIG. 1, the boughs B are shown in stick form. The boughs, branches or tree limbs B can be either artificial or natural. It is preferred that they be natural, so the imitation tree T will appear to be natural and it will also provide a natural aroma. The boughs B can be of any type of natural tree, such as, but not limited to, balsam fir, boxwood, cedar and pine. If it is preferred that the imitation tree T have a Christmas tree look, then the boughs B are preferred to be balsam fir boughs B. The natural types of boughs B can be supplied by lumber companies that "tip-off" natural trees. That is, the lumber companies remove the limbs from the trees. By using the boughs B that are trimmed off, no extra trees need to be cut down or destroyed and as such, there is a less of a harmful impact on the environment.

The boughs B are to be inserted into the tree all around the pillar P as well as on the top 20. Each bough B has a cut end 54 and a free end 56. It is the cut end 54 that is inserted into the pillar P. Because the pillar P is to be of a foam material, the boughs B are easily pushed into the pillar P. The boughs B should be of a length 58 such that the pillar P can support the boughs B. For example, if one was making a small or miniature tree T with a small pillar P, one would not want to use extraordinarily large boughs B. Accordingly, the length 58 of the boughs B should be proportionate to the size of the pillar P, so long as the pillar P can support the boughs B.

If natural boughs B are to be used, a user will need to pour water W or a liquid food supplement into the top 20 of the pillar P, so that the foam material of the pillar P will absorb the water W into its cells and become saturated. The cut ends 54 of the boughs B will absorb any water W or liquid, that is retained within the pillar P. Thus, the lives of the natural boughs B will be maintained.

An object of the present invention is to make this imitation tree T have a perfect shape and appear to be natural and full. Accordingly, the boughs B are to be inserted at different angles in order to make the tree T have a proper shape. Within the lower third portion 28 of the pillar P, the boughs B are to be inserted around the pillar P at an angle 60 of about 10 degrees to about 15 degrees from a horizontal reference. The boughs B are also to be inserted in the middle third portion 30 of the pillar P at an angle 62 of about 20 degrees to about 35 degrees from a horizontal reference. The boughs B are to be inserted into the pillar P in its upper third portion 32 at an angle 64 of about 45 degrees to about 70 degrees from a horizontal reference. At least one natural bough B is to be attached to the top 20 of the pillar P at an angle 66 of about 0 degrees to about 10 degrees from the longitudinal axis 68 of the pillar P. Placing the boughs B into the pillar P in this fashion will assist in making the tree T appear to have a natural shape.

To ensure that the imitation tree T has a full appearance, it is preferred that the boughs B be inserted into the pillar P at a density of about 1 bough B per square inch to about 4 boughs B per square inch of the pillar P.

Additionally, to aid in the presentation and perfect look of the tree, the boughs B after being inserted into pillar P should be trimmed at an angle 70 of about 15 degrees to about 45 degrees from the longitudinal axis 68 of the pillar P all around the longitudinal axis 68 of the pillar P, and is preferred to be about 30 degrees. It is understood that boughs B in the different portions, 28, 30 and 32, could be trimmed in numerous ways and at varying angles. For a miniature tree T, the trim angle 70 is the angle, measured from about 4 inches to about 5 inches from the top 20 of the pillar P, from the longitudinal axis 68.

For clarity of how the boughs B are to be inserted into the pillar P, the following is provided: the boughs B are inserted into the foam pillar P in the lower third portion 28 at an angle of about 75 degrees to about 80 degrees from the longitudinal axis 70; the boughs B are inserted into the foam pillar P in the middle third portion 30 at an angle of about 55 degrees to about 70 degrees from the longitudinal axis 70; and, the boughs B are inserted into the foam pillar P in the upper third portion 32 at angle of about 20 degrees to about 45 degrees from the longitudinal axis 70.

For a miniature Christmas tree T design, it is preferred that the length 58 of tile boughs B in the lower third portion 20 be about 10 inches to about 12 inches, prior to being trimmed. It is also preferred, for a miniature tree T, that the distance from the longitudinal axis 68 to free end 56 of the boughs B located in the lower third portion 28 of the pillar P be of about 16 inches to about 20 inches, after being trimmed. Additionally, it is preferred, for the miniature tree T, that after being trimmed: the length 58 of the boughs B, located in the lower third portion 28 to be about 7 inches to about 9½ inches; the boughs B located in the middle third portion 30 to be about 5½ inches to about 7 inches; the boughs B located in the upper third portion 32 to be about 4½ inches to about 6 inches; and, the boughs B located on the top portion 20 to be about 3 inches to about 4½ inches.

FIG. 3

Figure 3:
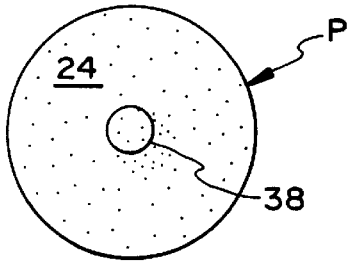
FIG. 3 is a bottom plan view of the pillar.

FIG. 3, a bottom plan view of the pillar P with the wick 38. As mentioned above, the wick 38 is optional. Its purpose is to absorb any excess water W that drips into the saucer SA and thus provide additional water W to the boughs B.

FIG. 4

Figure 4:
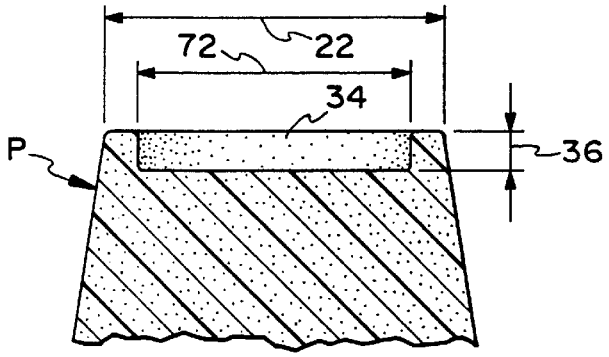
FIG. 4 is an exploded front elevational view of the top portion of the pillar.

Referring to FIG. 4, the pillar P is shown in cross-section with a break line. The well 34 has a well diameter 72 and a well depth of 36. Of course the well diameter 72 must be of lesser value then the top diameter 22 of the pillar P. For the miniature tree T, the well depth 36 is preferred to be of about ¼ inches to about ½ inches, and even further preferred to be about ¼ inches. Having this well 34 in the top 20 of the pillar P, will make it easy for the user to pour the water W or any liquid food supplement, into the pillar P. Thus, the user will pour the water W into this well 34 area and then the water will be disbursed throughout the pillar P. It is understood that more than one well 34 could be employed. That is, there could be numerous wells 34 located at varying depths within the pillar P.

FIG. 5

Figure 5:
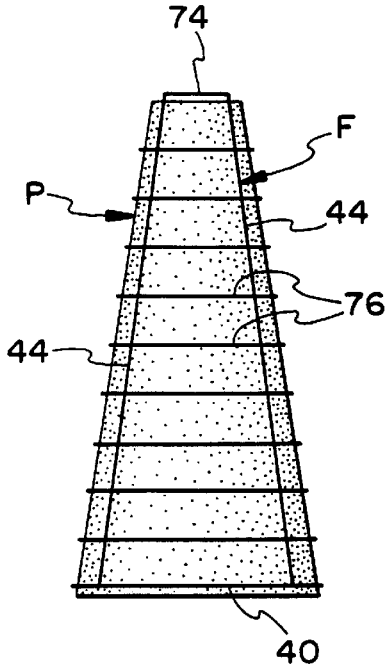
FIG. 5 is a front elevational view of an alternative embodiment of the pillar and the frame.
Figure 6:
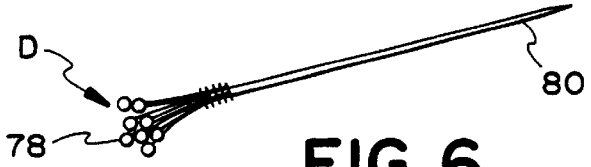
FIG. 6 is an isometric view of the holly decoration.
Figure 7:
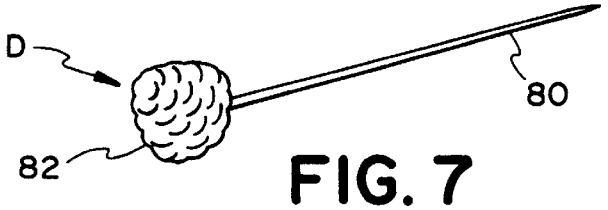
FIG. 7 is an isometric view of the pine cone decoration.
Figure 8:
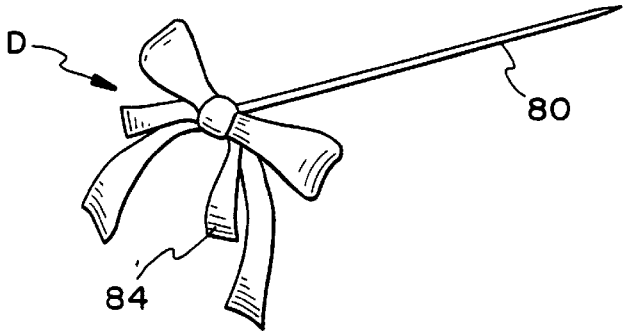
FIG. 8 is an isometric view of the bow decoration

FIG. 5 displays an alternative embodiment of the frame F about the pillar P. Here, the frame F consists of a top ring 74 a base ring 40 and a plurality of annular rings 76, rather than a conical spiral 48 (shown in FIG. 1). Also shown are support members 44. That is, each support member 44 is attached to the base ring 40, and extends to the top ring 74 and attaches thereto. Thus, the top ring 74 is the top 50 of this embodiment of the frame F. The annular rings 76 are disposed between the base and top rings 40 and 74 and are attached to the support members 44. The diameter of each ring decreases respectively from the base ring 40 to the top ring 74, to give the frame F a frustum-conical shape. Only three support members 44 of this type are needed (only two are shown in FIG. 5, but the third member 44 is on the other side). However, more members 44 could be employed. It is also noted that base ring 40, here in this embodiment, could also be like a snap ring discussed above. Additionally, the annular ring 76 closest to the base ring 40 could also be cut or discontinuous at one place to aid with the insertion of the frame F into the saucer SA.

Also shown in FIG. 5 is alternative embodiment of the pillar P, showing it without a wick 38.

FIG. 6

Decorations D are to be placed all around the tree to enhance the appearance of the tree T. One type of such decorations D are holly berries 78, which can be either real or imitation. The decorations D are attached with wire (not shown), to a florist pick 80, and then the pick 80 is inserted into the foam pillar P. The florist pick 80 extends the decoration D out from the pillar P to give the appearance that the decorations D are resting or supported by the boughs B.

FIG. 7

In this Figure, the decoration D shown is a pine cone 82. The pine cone 82 is also attached to a florist pick 80, with wire, not shown.

FIG. 8

The decoration D shown in this Figure is a bow or ribbon 84. The bow 84 is attached to a florist pick 80, with wire, not shown. It is preferred that the bow 84 be inserted or arranged to be on the top 20 of the pillar P.

FIG. 9

Figure 9:
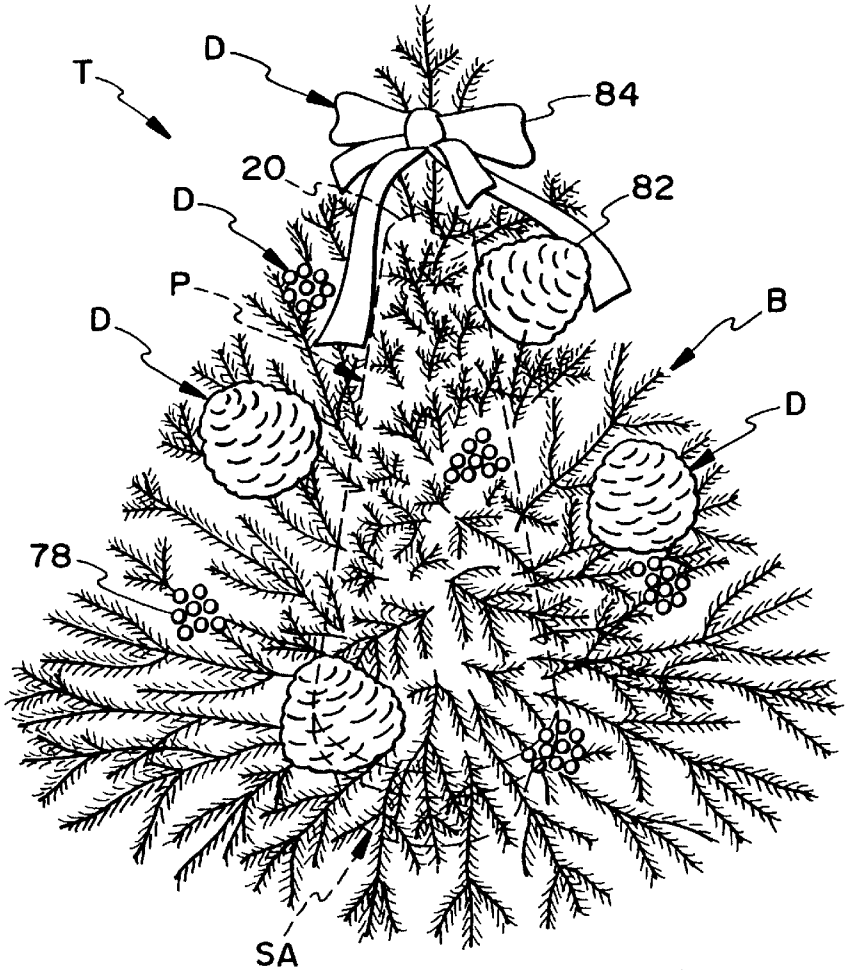
FIG. 9 is a top front perspective view of this novel imitation tree shown with decorations.

FIG. 9 displays a finished, trimmed and decorated imitation tree T. The saucer SA, as well as the pillar P and the boughs B can be seen. The bow 84 is placed at the top 20 of the pillar P. The pine cones 82 can be seen disbursed all about the tree T just as the holly berries 78 are. It is preferred that all of the components of the stand ST, namely, the pillar P, saucer SA and the frame F be the color green. This will aid in giving the tree T a fuller appearance.

Operation

In order to make this novel imitation tree T, the stand ST must first be produced. To do so, one must supply a saucer SA, as well as pillar P and a frame F. The pillar P is inserted into the saucer SA and then the frame F is placed over the pillar P and into the saucer SA.

Once the stand ST is completed, boughs B, preferably balsam or pine tips, need to be collected, gathered or bought. Once collected, the boughs B are to be inserted into tile stand ST in the manner described above. The boughs B are to be inserted into the pillar P so as to support the rest of the branch from falling to the ground.

With the boughs B inserted into the stand ST the free ends 56 all of the boughs B need to be trimmed at a continuous and constant angle 70 to give the tree T a perfect looking shape. Note, as described above, the boughs B could be trimmed at different angles to give the tree T a different shape.

Once trimmed, the tree T needs to be decorated with decorations D. Accordingly, decorations D need to be supplied, preferably fourteen imitation holly berries 78, fifteen pine cones 82 and one tartan bow 84.

If the imitation tree T is to be shipped, then a tree brace 86, as shown in FIG. 10, must be supplied. The tree brace 86 comprises an insertion member 88 a cross member 90 and a hook 92 attached to the insertion member 88. The insertion member 88 is attached to the cross member 90 to form a cross-like shape. The insertion member 88 is bent, to be able to be inserted into the pillar P, whereby the cross-like shape is maintained substantially parallel with the top 18 at the pillar P. The tree brace 86 is inserted into the top 20 of the pillar P until the hook 92 of the tree brace 86 reaches and intersects the top 50 of the frame F. The hook 92, which catches or snags a support member 44, prevents the tree brace 86 from proceeding farther into the pillar P. The tree brace 86 allows the imitation tree T to be inserted into a shipping box, not shown, whereby the box will not crush the imitation tree T. In other words, the tree brace 86 squares off the top of the imitation tree T for uniform fitting into a box, not shown. Note, FIG. 10 does not display the boughs B or the decorations D; however, they were not shown for clarity purposes.

If natural boughs B are used in the imitation tree T the tree T will need to be watered with water W or supplied with a liquid food supplement. The owner of tree T will need to pour approximately one quart of cool water W slowly (about one minute) into the well 34 of the pillar P or in the area at the base of the bow 84. If while pouring the water W into the pillar P, the water W starts to spill out from the tree T, then the water W needs to be added more slowly.

While this invention has been described as having a preferred design, it is understood that it is capable of further modifications, of uses and/or adaptations of the invention following in general the principal of the invention and including such departures from the present disclosure as come within the known or customary practice in the art to which the invention pertains, and as may be applied to the central features herein before set forth, all fall within the scope of the invention and of the limits of the appended claims.

What is claimed is:

1. A process of manufacturing an imitation tree, comprising:

a) providing a base support;

b) providing a frame having an interior volume;

c) providing a foam pillar;

d) placing the foam pillar substantially within the interior volume of the frame;

e) securing the frame to the base support;

f) providing a plurality of boughs; and, g) inserting the plurality of boughs along the length of the foam pillar to form the shape of a tree.

2. A process as recited in claim 1, wherein said inserting step includes:

a) disposing the plurality of boughs from the bottom portion to the top portion of the foam pillar at a decreasing angle of inclination with respect to the longitudinal axis of the foam pillar.

3. A process as recited in claim 1, further comprising:

a) dividing the outer surface of the foam pillar into reference portions for said inserting step.

4. A process as recited in claim 3, wherein said dividing step includes:

a) defining a lower third, a middle third and an upper third reference portions of the foam pillar.

5. A process as recited in claim 4, wherein said inserting the plurality of boughs step includes:

a) inserting at least one of the plurality of boughs in the lower third reference portion at an angle of about 75 degrees to about 80 degrees from the longitudinal axis of the foam pillar.

6. A process as recited in claim 4, wherein said inserting the plurality of boughs step includes:

a) inserting at least one of the plurality of boughs in the middle third reference portion at an angle of about 55 degrees to about 70 degrees from the longitudinal axis of the foam pillar.

7. A process as recited in claim 4, wherein said inserting the plurality of boughs step includes:

a) inserting at least one of the plurality of boughs in the upper third reference portion at an angle of about 20 degrees to about 45 degrees from the longitudinal axis of the foam pillar.

8. A process as recited in claim 1, further comprising:

a) trimming the boughs.

9. A process as recited in claim 8, wherein said trimming the boughs step includes:

a) trimming the boughs to provide an overall frustum-conical shape to the tree.

10. A process as recited in claim 1, wherein said providing a frame step includes:

a) providing a frame having an overall frustum-conical shape.

11. A process as recited in claim 1, wherein said providing a frame step includes:

a) providing a frame comprised of a frustum-conical wire spiral.

12. A process as recited in claim 1, wherein said providing a frame step includes:

a) providing a frame comprising a plurality of annular rings.

13. A process as recited in claim 1, wherein said providing a foam pillar step includes:

a) providing a foam pillar comprising numerous fluid retaining cells.

14. A process as recited in claim 1, wherein said providing a foam pillar step includes:

a) providing a foam pillar having a top portion with a well formed therein.

15. A process as recited in claim 1, further comprising:

a) providing a wick adjacent the foam pillar and extending toward the base support.

16. A process as recited in claim 1, wherein:

a) said providing a foam pillar step includes providing a foam pillar having a top portion; and, b) said inserting a plurality of boughs step includes inserting at least one bough into the top portion of the foam pillar.

17. A process as recited in claim 1, further comprising:

a) providing a plurality of decorations; and, b) attaching the plurality of decorations to the foam pillar.

18. A method of manufacturing a frame for use in making an imitation tree, comprising:

a) providing a wire frame defining an interior volume for receiving therein a foam pillar adapted to support a plurality of boughs; and, b) defining with the frame a plurality of reference portions on the outer surface of the foam pillar for placement of the boughs into the foam pillar.

19. A method as recited in claim 18, wherein said providing a wire frame step includes:

a) providing a wire spiral frame.

20. A method as recited in claim 18, wherein said providing a wire frame step includes:

a) providing a wire frame comprising a plurality of annular rings.

21. A method as recited in claim 18, wherein said providing a wire frame step includes:

a) providing a wire frame having a frustum-conical shape.

22. A method as recited in claim 18, wherein said providing a wire frame step includes:

a) providing a base ring;

b) providing a spiral having a height and a base end;

c) attaching the base end of the spiral to the base ring;

d) providing a support member having an end;

e) attaching the end of the support member to the base ring;

f) extending the support member along the height of the spiral; and, g) attaching the support member to the spiral.

23. A method as recited in claim 18, wherein said providing a wire frame step includes:

a) providing a wire frame having a compressible base ring.

24. A method as recited in claim 18, wherein said providing a wire frame step includes:

a) providing a base ring;

b) providing a top ring;

c) providing an intermediate ring;

d) disposing the intermediate ring between the base ring and the top ring;

e) providing a support member; and, f) attaching the support member to the base ring, the intermediate ring and the top ring.

* * * * *